US011622606B1

(12) United States Patent
Lin

(10) Patent No.: US 11,622,606 B1
(45) Date of Patent: Apr. 11, 2023

(54) BUCKLE WITH ROTOR CYLINDER

(71) Applicant: Duraflex Hong Kong Limited, Hong Kong (CN)

(72) Inventor: Po Chu Lin, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/690,471

(22) Filed: Mar. 9, 2022

(51) Int. Cl.
*A44B 11/22* (2006.01)

(52) U.S. Cl.
CPC ..... *A44B 11/22* (2013.01); *A44D 2203/00* (2013.01)

(58) Field of Classification Search
CPC ..... A44B 11/22; A44B 11/24; A44B 11/2511; A44B 11/2526; A44B 11/2542; A44B 11/263; A44B 11/233; A44D 2203/00
See application file for complete search history.

(56) References Cited

U.S. PATENT DOCUMENTS 2,933,795 A * 4/1960 Meeker ..... A44B 11/2526 24/647
3,481,009 A * 12/1969 Ligon ..... A44B 11/2511 24/637
4,766,654 A * 8/1988 Sugimoto ..... A44B 11/2511 24/651
5,406,681 A * 4/1995 Olson ..... A44B 11/2561 24/579.11
8,656,566 B1 * 2/2014 Chen ..... A44B 11/2511 24/642

* cited by examiner

*Primary Examiner* — Robert Sandy
(74) *Attorney, Agent, or Firm* — Collard & Roe, P.C.

(57) ABSTRACT

A buckle assembly is formed by a male portion, a female portion and a rotor. The male portion has a base body, and at least one locking leg having a first latching element. The female portion has a base body with an interior cavity and at least one guide slot. The rotor is seated in the interior cavity and has an actuation surface, a second latching element for engagement with the first latching element, and an actuating mechanism that orients the rotor in a locked position in a resting state of the buckle assembly. The male portion is locked to the female portion by inserting the locking leg into guide slot until the first latching element engages the second latching element. The male portion is released from the female portion by pressing the actuation surface to rotate the rotor until the latching elements are disengaged from each other.

11 Claims, 5 Drawing Sheets

BUCKLE WITH ROTOR CYLINDER

BACKGROUND OF THE INVENTION

1. Field of the Invention

This invention relates to a two-piece buckle that uses a rotor cylinder to lock the two pieces together. In particular, the invention relates to a buckle in which the rotor cylinder is mounted one of the pieces and is biased into the locked position, but can be rotated into an unlocking position under pressure to release the buckle.

2. The Prior Art

A typical side release buckle is achieved by setting a load-bearing buckle point on a bendable locking leg of a male buckle, and manually pressing the locking leg so as to switch the position of the load-bearing buckle point before and after bending, thus achieving the purpose of buckling or unbuckling.

These products have many advantages, such as a simple structure, low cost, and easy operation. However, the load is transferred through the locking leg and is therefore susceptible to deformation of the locking leg, resulting in pull-off and breakage. Large fluctuations of upper and lower limits can be observed from the value of a pressure test. The pressing force (feel) required for unbuckling is often proportional to the ultimate load-bearing capacity of the product. This often forces the designer to make a trade-off between ease of use and strength of the buckle. If the pressing feel is light, the bearing capacity will be low; and on the contrary, if the pressing feel is hard, the bearing capacity will be improved, but the buckle will be difficult to operate.

It would be desirable to construct a buckle where the load is not applied to the locking legs but to a rigid body that does not have the risk of deformation and breakage.

SUMMARY OF THE INVENTION

This object is accomplished by a buckle assembly formed by a male portion, a female portion, and a rotor. The male portion comprises a base body and at least one locking leg extending in an insertion direction from the base body. The locking leg has a first latching element extending from the locking leg. The female portion comprises a base body with an interior cavity and at least one guide slot that corresponds to the locking leg of the male portion. The rotor is formed by a cylindrical element that is configured to be seated in the interior cavity of the female portion. The rotor has an actuation surface configured to be accessed by the user through an opening in the female portion, at least one second latching element that is configured for engagement with the first latching element of the at least one locking leg of the male portion, and an actuating mechanism that orients the rotor in a locked position in a resting state of the buckle assembly. The male portion is locked to the female portion by inserting the at least one locking leg into the at least one guide slot until the first latching element of the at least one locking leg engages the at least one second latching element of the rotor. During insertion, the first latching element presses against the second latching element and forces the rotor to rotate until the first latching element passes the second latching element, at which point the rotor returns to its resting and locked state. The male portion is released from the female portion by pressing the actuation surface to rotate the rotor until the second latching element is disengaged from the first latching element, at which point the male portion can be pulled away from the female portion.

Preferably, there are at least two locking legs on the male portion, each one of the locking legs having one first latching element, and the rotor has two second latching elements which engage the two first latching elements when the male portion is locked to the female portion. The locking legs are preferably disposed on opposite sides of the main body of the male portion and extend parallel to each other, and the latching elements are located on the interior faces of the locking legs, so that the first latching elements face each other. The two second latching elements are located on opposite face sides of the rotor, facing outward. The engagement of the first and second latching elements does not require the locking legs to bend at all, because the movement of the latching elements relative to each other takes place solely through rotation of the rotor. This way, the locking legs can be formed to be very strong and non-bending. Nevertheless, since the locking legs are not deformed inward to lock the buckle, the locking legs can be made of any desired material or flexion without compromising the strength of the buckle connection.

The buckle assembly is generally used to connect two pieces of webbing together. In this respect, the male portion and the female portion each have a strap attaching bar connected to their respective base bodies.

In a preferred embodiment, the first latching element comprises a protrusion having an engaging surface extending perpendicular to the insertion direction, and the second latching element comprises a wall segment that in the locked position abuts the engaging surface to prevent disengagement of the male portion from the female portion. The wall segment extends outwardly from the rotor, essentially parallel to a rotational axis of the rotor, and faces the engaging surface of the first latching element when the buckle is in the locked position. Once the protrusion passes the wall segment as the male portion is inserted into the guide slot, the rotor rotates back to its resting position under pressure from the actuating mechanism, so that the wall segment blocks any backwards movement of the male portion.

Preferably, the first latching element has a sloped surface extending in the insertion direction, such that inserting the male portion into the female portion causes the sloped surface to slide along the second latching element of the rotor to rotate the rotor until the engaging surface passes the wall segment, at which point the rotor moves into the locked position. This way, no additional effort by the user is required in order to lock the two buckle portions together.

The actuating mechanism can be formed in several different ways, and can also be a combination of different mechanisms. In one embodiment, the actuating mechanism comprises a magnet disposed in the rotor, and a cooperating magnet disposed in the male portion, the magnets having a greatest amount of overlap and attraction in the locked position, such that when force is placed on the rotor by the male portion or by pressing the actuation surface to rotate the rotor out of the locked position, the magnets move the rotor back to the locked position when the force is released. The magnets can be used alone or can be used in combination with a spring that biases the rotor into the locked position. The advantage to using the magnets is that the attractive force of the magnets also aids in bringing the male and female portions together, as well as assisting in alignment of the two buckle portions into the proper positions.

Alternatively, the spring can be used alone without the magnets. The spring can be any suitable type of spring, such as a coil spring or a flat spring. The spring can be disposed underneath the actuating surface of the rotor, so that pressing down on the actuating surface compresses the spring, and releasing the actuating surface allows the spring to return to its resting position. In one embodiment, the female portion comprises a shell that surrounds a rear portion of the rotor, such that the rotor is connected to the female portion by snapping the flange into the shell. This shell can also comprise the actuating mechanism and as such be in the form of a flat spring, such that applying force to the rotor by pressing the actuating surface or inserting the male portion rotates the rotor and consequently bends the shell downward, and releasing the force causes the shell to return to a resting state, placing the rotor back in the locked position. In an alternative embodiment, the actuating mechanism can be formed by a spring, but magnets are also positioned in the male portion and rotor or female portion in a way that the magnets repel each other. This way, once the actuating mechanism is pressed to disengage the latching mechanisms, the male and female buckle portions are forced away from each other due to the repulsive force of the magnets.

With the buckle assembly of the present invention, the required functions are divided into different structural parts, so that the buckle can be easily unbuckled with low force required, yet the buckle maintains superior and stable load-bearing capacity.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 4:
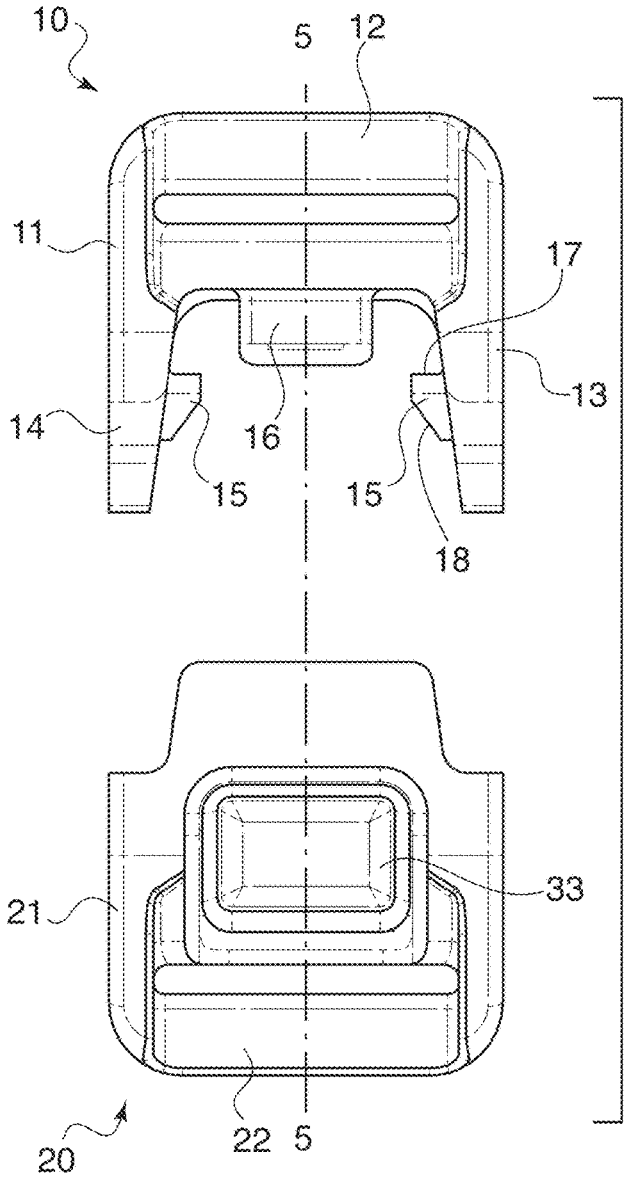
FIG. 4 shows a top view of the buckle assembly.

Referring now in detail to the drawings, FIGS. 1-4 show the buckle assembly 1 according to the invention. Buckle assembly 1 is formed of a male portion 10, a female portion 20, and a rotor 30. Male portion 10 is formed by a base body 11, a strap attaching bar 12 connected to one end of base body 11, and two locking legs 13, 14, extending from the other end of base body 11 and parallel to each other. Locking legs 13, 14 each have a first latching element 15 extending from an inside face of locking legs 13, 14, as shown in FIG. 4. A magnet casing 16 extents from base body 11, and holds magnet 40.

First latching element 15 has an engagement face 17 and a sloped sliding surface 18, so that first latching element 15 widens and increases in height (see FIGS. 7-10) towards the rear of male buckle portion 10 as it approaches engagement face 17.

As shown in FIGS. 1-4, female portion 20 comprises a base body 21 connected to a strap retaining bar 22. Female portion 20 has an interior cavity 23, a top opening 24 communicating with interior cavity 23, and a front opening 25, also communicating with interior cavity 23.

Rotor 30 has a cylindrical body 31 with aperture 32, a cavity for holding magnet 50, and an actuation surface 33. On each opposite face side 34, 35 of rotor 30 is a second latching element 36, which extends outward from face sides 34, 35 and forms a wall 37 that extends approximately parallel to an axis of rotation R of rotor 30.

Figure 1:
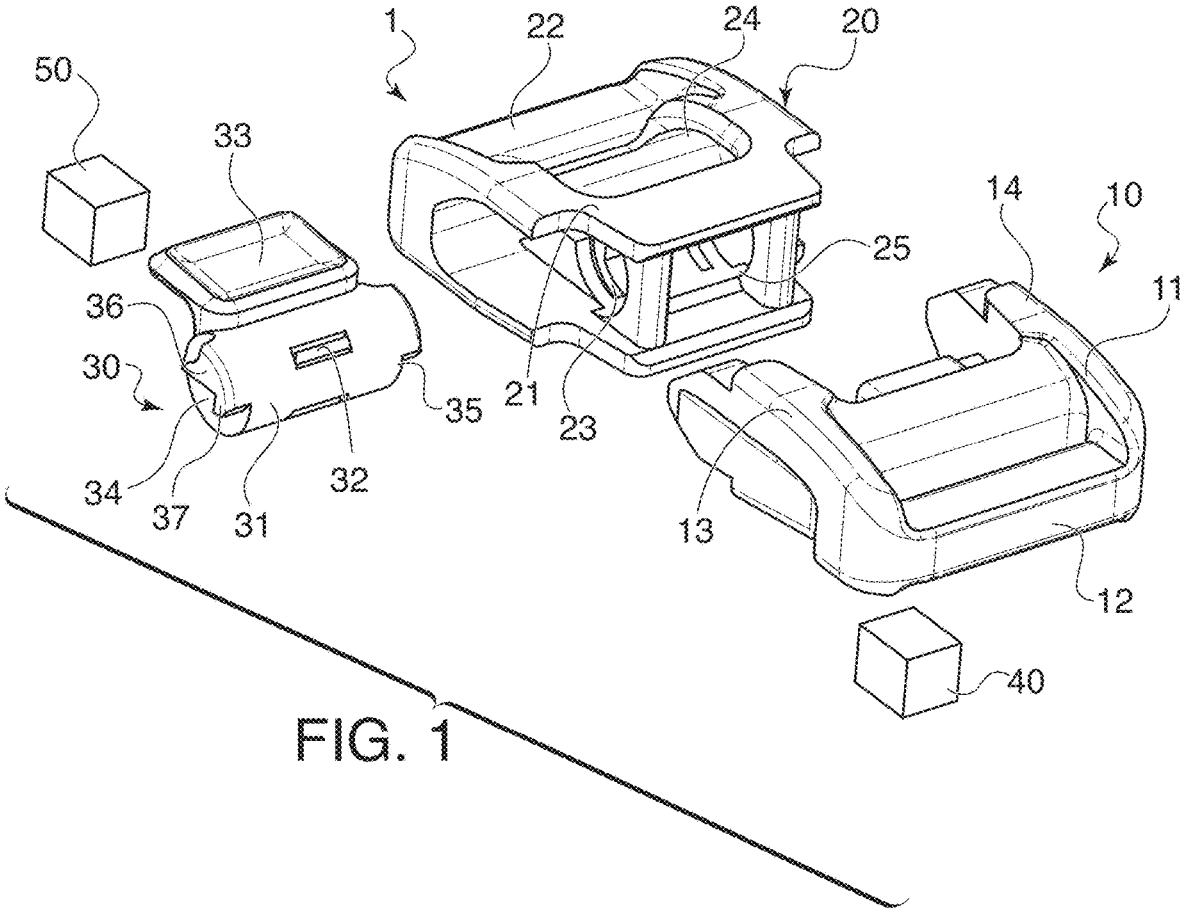
FIG. 1 shows an exploded view of the buckle assembly according to the invention.
Figure 2:
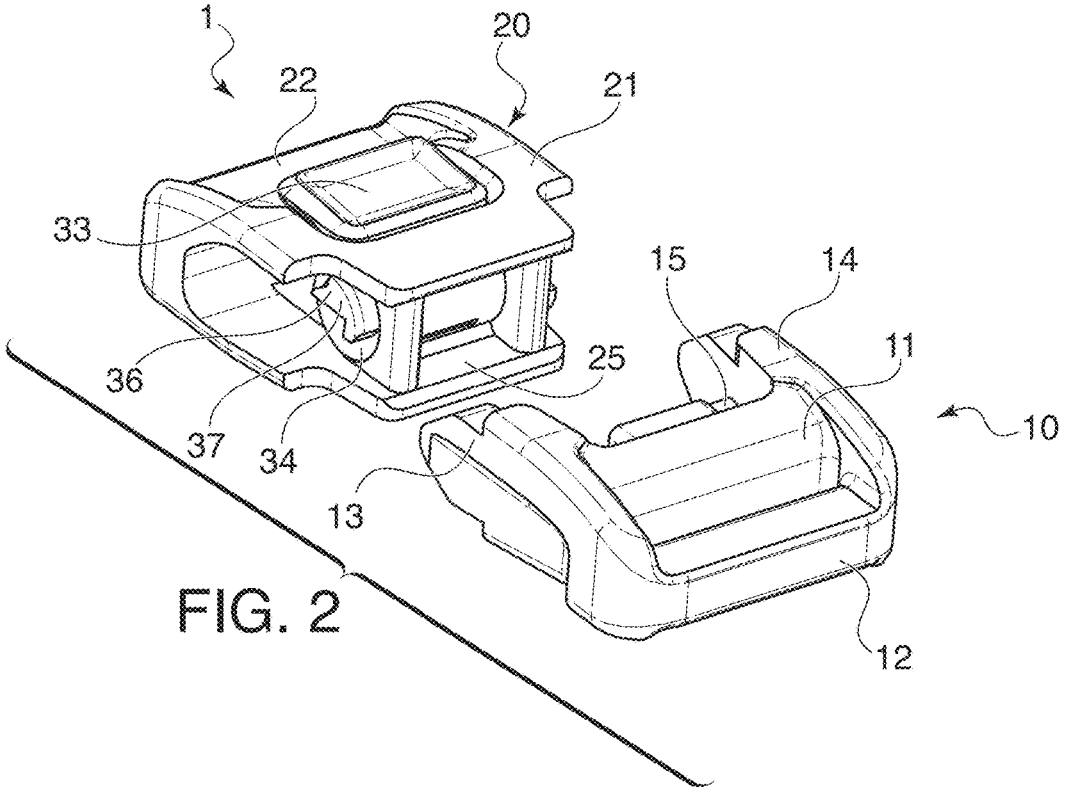
FIG. 2 shows an exploded view of the buckle assembly with the rotor assembled in the female portion.
Figure 3:
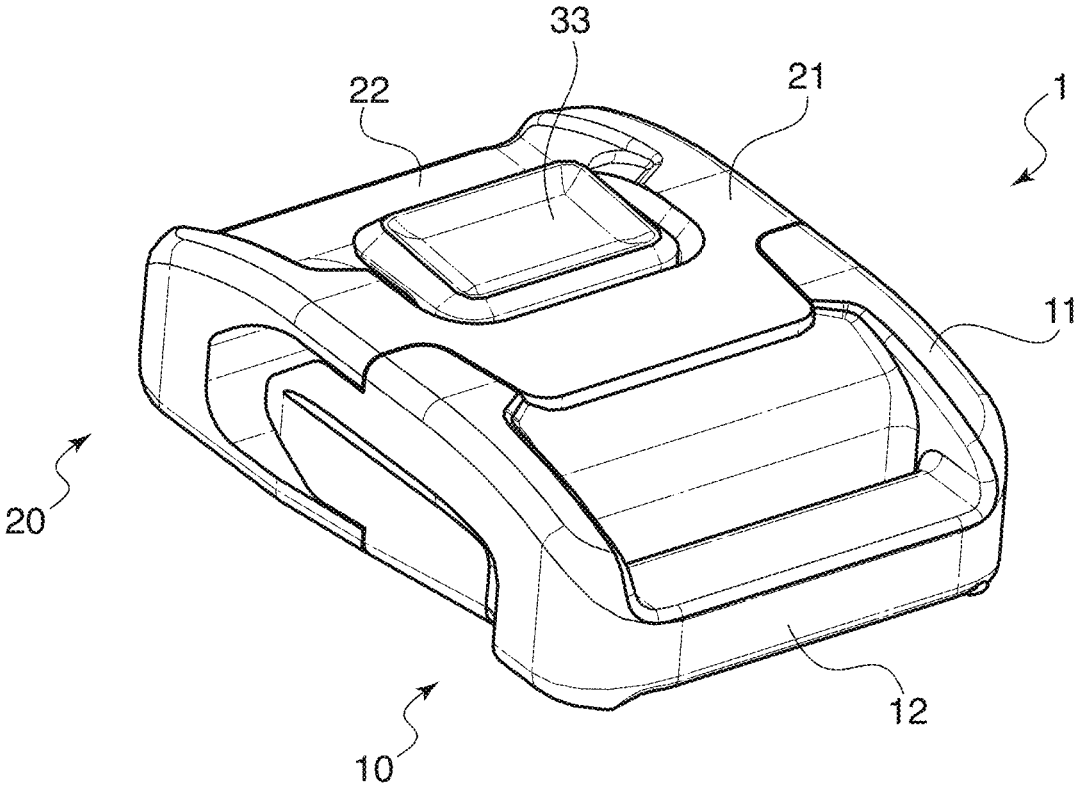
FIG. 3 shows the buckle assembly in an assembled state.

Rotor 30 is inserted into cavity 23 of female portion 20 by inserting it through the openings in the sides until actuation surface 33 extends through top opening 24 as seen in FIG. 2. As shown in the cross-section in FIG. 5, rotor 30 is held in cavity 23 by a cylindrical shell portion 28. Shell portion 28 can be constructed to be flexible, so that rotor 30 can be snapped into shell portion 28 to hold it in female portion 20.

Magnets 40, 50 can be arranged so as to attract each other when male portion 10 is brought near female portion 20. In this way, the magnets can act to align the buckle portions for proper positioning during locking, as well as to keep the rotor in a locked position when not under external force.

Figure 6:
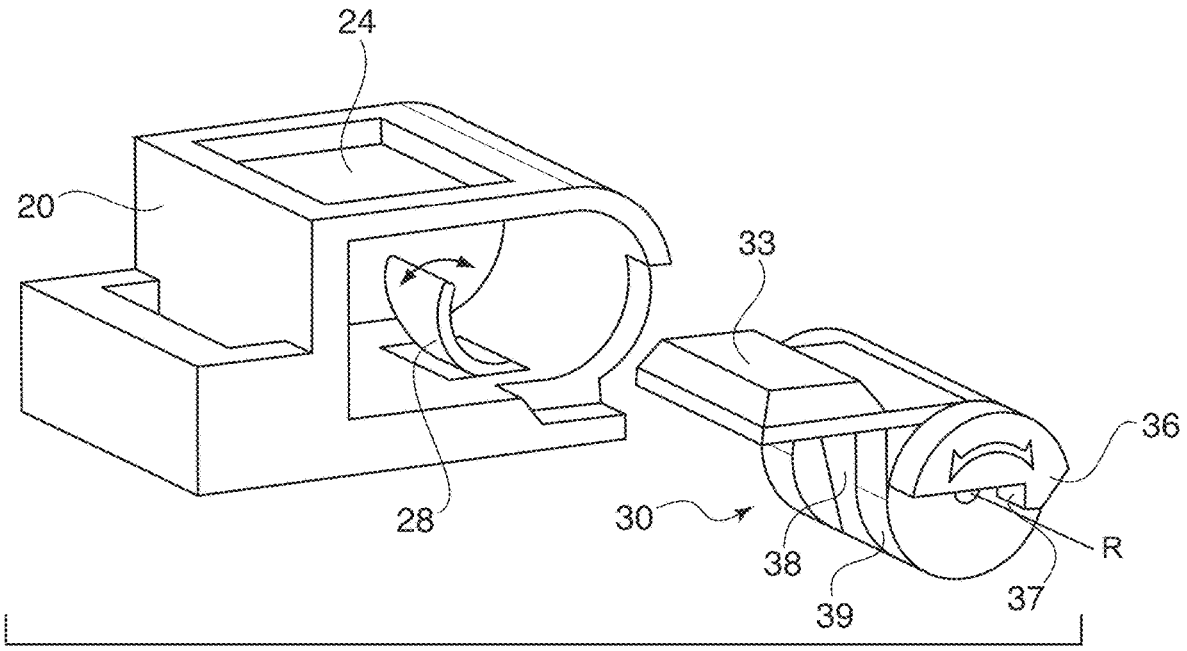
FIG. 6 shows a simplified view of the female portion and rotor, with the guide slots of the female portion removed for ease of illustration.

FIG. 6 shows a simplified view of female portion 20 and the connection system with rotor 30. Rotor 30 is held in place by cylindrical shell portion 28, which flexes to allow for insertion of rotor 30, but rests firmly against rotor 30 once rotor 30 is inserted. As can be seen in FIG. 6, rotor 30 has in flat rear central face 38 and side portions 39. Shell portion 28 snaps in between side portions 39, which extend beyond shell portion 28 and prevent exit of the rotor 30 from female portion 20, The locking and unlocking of male portion 10 and rotor 30 (which in practice is mounted in female portion 20 is shown schematically in FIGS. 7-10 in two different embodiments. In these figures, the buckle portions and rotor are depicted in a simplified fashion so as to more clearly show the interaction of the latching elements during locking and unlocking, but can take the form of the corresponding elements with the same reference numerals of FIGS. 1-4. For example, in these figures, portions of locking legs 13, 14 have been removed so as to clearly see the interaction between the first latching elements 15 and second latching elements 36.

Figure 7:
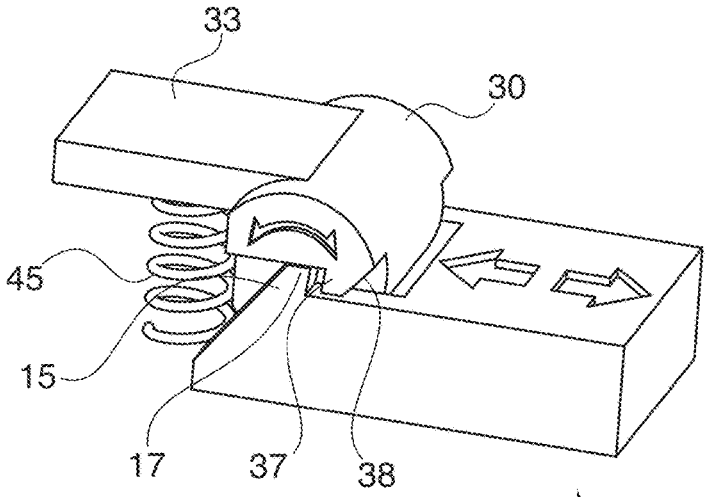
FIG. 7 shows a simplified schematic view of the engagement of the rotor with the male portion using a spring as the actuating mechanism.
Figure 8:
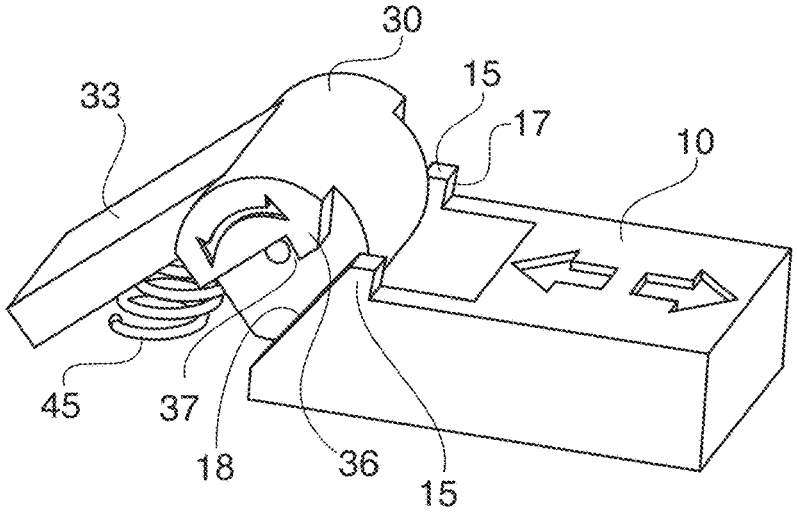
FIG. 8 shows the embodiment of FIG. 7 in an unlocking process.

In the embodiment of FIGS. 7 and 8, a spring 45 is positioned underneath actuation surface 33 to provide a restoring force to keep rotor 30 in the locked position. As can seen in FIG. 7, engagement face 17 of first latching element 15 abuts wall 37 of second latching element 36, in the locked position of buckle assembly 1. This prevents any exit of male portion 10 from female portion 20 when rotor 30 is locked into female portion 20 as shown in FIGS. 1-4. To release male portion 10, the user presses down on actuation surface 33 of rotor 30, as shown in FIG. 8. This compresses spring 45 and rotates rotor 30 until wall 37 passes engagement face 17, to free second latching element 36 from first latching element 15, which then allows the user to pull male portion away from rotor 30 (and female portion 20 to which it is connected). Connection of the male portion 10 to rotor 30 can take place without depressing engagement surface 30, as second latching element 36 slides along sliding surface 18 of first latching element 15 during the connection process, and allows wall 37 to pass over engagement surface 17 before snapping into place in the locked position. Rotor 38 can also have a complementary sloped portion 38 that slides along sliding surface 18 during insertion, to minimize frictional resistance during the connection process.

Figure 5:
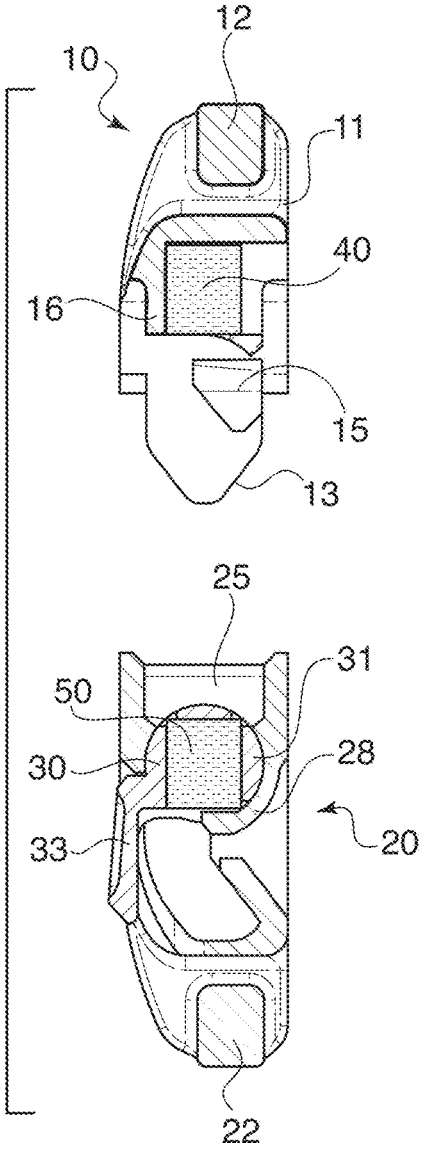
FIG. 5 shows a side-cross sectional view of the buckle assembly along lines 5-5 of FIG. 4.

Instead of the coil spring shown, shell portion 28 as shown in FIGS. 5 and 6 can also function as the spring to keep rotor 30 in the locked position in a resting state. Pressing actuation surface 33 downward causes rotor 30 to rotate and press shell portion 28 downward as well to release the buckle assembly. Rotor 30, having a flat rear central face 38, cannot rotate within shell portion 28, so any movement of rotor 30 causes shell portion 28 to move with rotor 30. As soon as actuation surface 33 is released, shell portion 28 snaps back to its resting position and thus moves rotor 30 back to its locked resting position as well.

Figure 9:
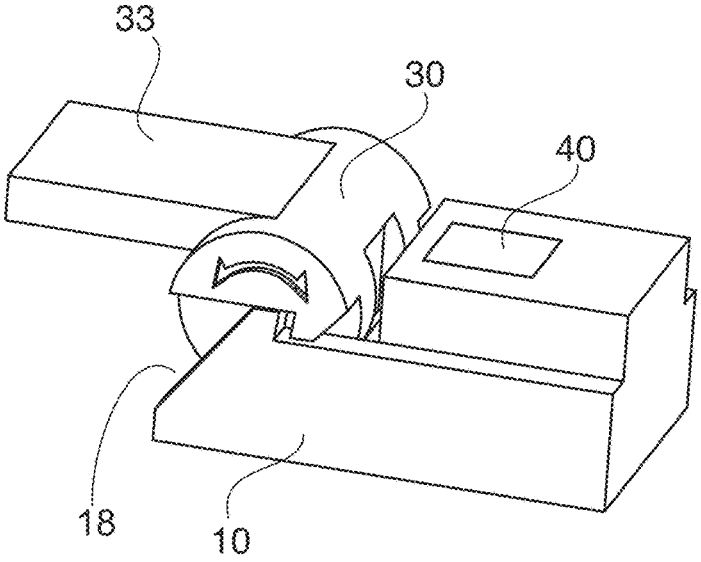
FIG. 9 shows a simplified schematic view of the engagement of the rotor with the male portion using magnet as the actuating mechanism.
Figure 10:
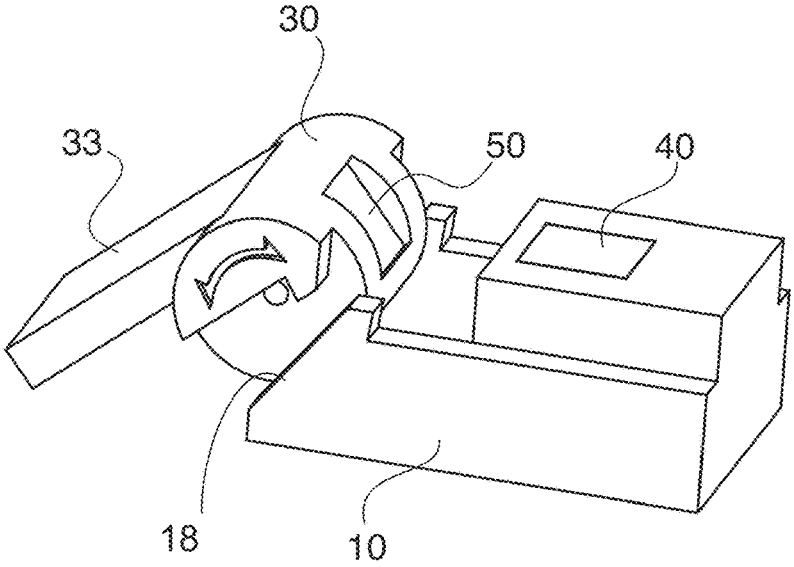
FIG. 10 shows the embodiment of FIG. 9 in an unlocking process.

The embodiment of FIGS. 7 and 8 could also incorporate the use of magnets 40, 50, or magnets 40, 50 can be used without a spring, such as shown in the embodiment of FIGS. 9 and 10. Here, the attractive force of magnets 40, 50 holds rotor 30 in the locked position, and pressure on engagement surface 33 of rotor 30 rotates rotor 30 out of the locked position, against the attractive force of magnets 40, 50. Magnets 40, 50 also aid in bringing the male portion 10 and female portion 20 with rotor 30 attached into proper alignment prior to locking. Releasing engagement surface 33 allows rotor 30 to be moved back into the locked position shown in FIG. 9, by the attractive force of magnets 40, 50. Because the connection between male portion 10 and rotor 30 is strong and secure once in the locked position, it is not necessary to require a large amount of force to move the rotor, which consequently allows for a buckle that is highly stable, yet easy to release. The releasing movement takes place in a different direction (i.e., via rotation) than the lateral pressure on the buckle, so that the two mechanisms, i.e., the mechanism for release, and the mechanism holding the two parts together under pressure from straps, can be constructed separately and with different levels of force required.

In a further embodiment, which can be envisioned using the embodiment of FIGS. 7 and 8, magnets can be positioned in male portion 10 and rotor 30, in the same manner shown in FIGS. 9 and 10, so that both a spring and magnets are used to lock and unlock buckle assembly 1. Here, pressing on engagement surface 33 must overcome both the attractive force of the magnets 40, 50 as well as the spring force of spring 45 in order to unlock buckle assembly 1. In a further embodiment, the magnets can be placed so as to have a repelling force with respect to each other. This way, once the latching elements 15, 36 clear each other after pressing on engagement surface 33, the buckle parts are pushed away from each other due to the repelling force of the magnets. In this case, the user must apply additional force to overcome the repelling force of the magnets in order to connect the buckle parts to each other.

Accordingly, while only a few embodiments of the present invention have been shown and described, it is obvious that many changes and modifications may be made thereunto without departing from the spirit and scope of the invention.

What is claimed is:

1. A buckle assembly comprising:

a male portion comprising a base body, and two locking legs extending in an insertion direction from the base body, said locking legs each having a first latching element thereon;

a female portion comprising a base body with an interior cavity, the base body having two guide slots; and a rotor configured to be seated in the interior cavity of the female portion, the rotor having an actuation surface configured to be accessed through the female portion, two second latching elements that are configured for engagement with the first latching elements of the male portion, and an actuating mechanism that orients the rotor in a locked position in a resting state of the buckle assembly, wherein the male portion is locked to the female portion by inserting the locking legs into the guide slots until the first latching elements of the locking legs engage the second latching elements of the rotor, and wherein the male portion is released from the female portion by pressing the actuation surface to rotate the rotor until the second latching elements are disengaged from the first latching elements.

2. The buckle assembly according to claim 1, wherein the male portion and the female portion each have a strap attaching bar connected to their respective base bodies.

3. The buckle assembly according to claim 1, wherein each first latching element comprises a protrusion having an engaging surface extending perpendicular to the insertion direction, and wherein each second latching element comprises a wall segment that in the locked position abuts the engaging surface of a corresponding one of the first latching elements to prevent disengagement of the male portion from the female portion.

4. The buckle assembly according to claim 3, wherein each one of the first latching elements has a sloped surface extending in the insertion direction, such that inserting the male portion into the female portion causes the sloped surface to slide along the corresponding second latching element of the rotor to rotate the rotor until the engaging surface passes the wall segment, at which point the rotor moves into the locked position.

5. The buckle assembly according to claim 1, wherein the actuating mechanism comprises a spring connected to the rotor, the spring being configured to move the rotor to the locked position and maintain the rotor in the locked position when force is not applied to the actuation surface.

6. The buckle assembly according to claim 5, wherein the actuating mechanism further comprises a magnet disposed in the rotor and a cooperating magnet disposed in the male portion, the magnets having a greatest amount of overlap and attraction to each other in the locked position, such that when force is placed on the rotor by the male portion or by pressing the actuation surface to rotate the rotor out of the locked position, the magnets move the rotor back to the locked position when the force is released.

7. The buckle assembly according to claim 5, further comprising a magnet disposed in the rotor and a magnet disposed in the male portion, the magnets being oriented so as to repel each other when the male portion is in proximity to the rotor, such that the magnets force the male portion away from the rotor when the actuation surface is pressed to release the first latching element from the second latching element.

8. The buckle assembly according to claim 1, wherein the locking legs are disposed on opposite sides of the main body of the male portion and extend parallel to each other, wherein the first latching elements face each other and wherein the two second latching elements are located on opposite face sides of the rotor.

9. A buckle assembly comprising:

a male portion comprising a base body, and at least one locking leg extending in an insertion direction from the base body, said at least one locking leg having a first latching element thereon;

a female portion comprising a base body with an interior cavity, the base body having at least one guide slot; and a rotor configured to be seated in the interior cavity of the female portion, the rotor having an actuation surface configured to be accessed through the female portion, at least one second latching element that is configured for engagement with the first latching element of the male portion, and an actuating mechanism that orients the rotor in a locked position in a resting state of the buckle assembly, wherein the male portion is locked to the female portion by inserting the at least one locking leg into the at least one guide slot until the first latching element of the at least one locking leg engages the second latching element of the rotor, and wherein the male portion is released from the female portion by pressing the actuation surface to rotate the rotor until the second latching element is disengaged from the first latching element, and wherein the actuating mechanism comprises a magnet disposed in the rotor and a cooperating magnet disposed in the male portion, the magnets having a greatest amount of overlap and attraction to each other in the locked position, such that when force is placed on the rotor by the male portion or by pressing the actuation surface to rotate the rotor out of the locked position, the magnets move the rotor back to the locked position when the force is released.

10. A buckle assembly comprising:

a male portion comprising a base body, and at least one locking leg extending in an insertion direction from the base body, said at least one locking leg having a first latching element thereon;

a female portion comprising a base body with an interior cavity, the base body having at least one guide slot; and a rotor configured to be seated in the interior cavity of the female portion, the rotor having an actuation surface configured to be accessed through the female portion, at least one second latching element that is configured for engagement with the first latching element of the male portion, and an actuating mechanism that orients the rotor in a locked position in a resting state of the buckle assembly, wherein the male portion is locked to the female portion by inserting the at least one locking leg into the at least one guide slot until the first latching element of the at least one locking leg engages the second latching element of the rotor, and wherein the male portion is released from the female portion by pressing the actuation surface to rotate the rotor until the second latching element is disengaged from the first latching element wherein the female portion comprises a shell extending into the interior cavity, and wherein the rotor is connected to the female portion by sliding the rotor into the shell.

11. The buckle assembly according to claim 10, wherein the shell also comprises the actuating mechanism, such that applying force to the rotor by pressing the actuation surface or inserting the male portion rotates the rotor and bends the shell downward, and releasing the force causes the shell to return to a resting state, placing the rotor in the locked position.

* * * * *